US011715878B2

(12) United States Patent
Feng et al.

(10) Patent No.: US 11,715,878 B2
(45) Date of Patent: Aug. 1, 2023

(54) THREE-DIMENSIONAL ELECTRONIC COMPONENT AND ELECTRONIC DEVICE

(71) Applicant: ASUSTeK COMPUTER INC., Taipei (TW)

(72) Inventors: Zhi-Hua Feng, Taipei (TW); Chia-Ho Lin, Taipei (TW); Pin-Tang Chiu, Taipei (TW); Zhen-De Jiang, Taipei (TW)

(73) Assignee: ASUSTEK COMPUTER INC., Taipei (TW)

( * ) Notice: Subject to any disclaimer, the term of this patent is extended or adjusted under 35 U.S.C. 154(b) by 134 days.

(21) Appl. No.: 17/476,544

(22) Filed: Sep. 16, 2021

(65) Prior Publication Data

US 2022/0102862 A1 Mar. 31, 2022

(30) Foreign Application Priority Data

Sep. 30, 2020 (TW) ..... 109134311

(51) Int. Cl.
*H01Q 9/04* (2006.01)
*H01Q 1/48* (2006.01)
*H01Q 5/357* (2015.01)

(52) U.S. Cl.
CPC ..... *H01Q 9/0457* (2013.01); *H01Q 1/48* (2013.01); *H01Q 5/357* (2015.01); *H01Q 9/0471* (2013.01)

(58) Field of Classification Search
CPC ..... H01Q 1/48; H01Q 9/0471; H01Q 5/371; H01Q 9/0421; H01Q 5/357
See application file for complete search history.

(56) References Cited

U.S. PATENT DOCUMENTS 5,510,802 A * 4/1996 Tsuru ..... H01Q 9/42 343/849
5,903,240 A * 5/1999 Kawahata ..... H01Q 19/005 343/702
6,133,881 A * 10/2000 Kushihi ..... H01Q 1/243 343/702

(Continued)

FOREIGN PATENT DOCUMENTS

CN 206076499 U 4/2017
CN 109216885 A 1/2019
WO WO-0124316 A1 * 4/2001 ..... H01Q 1/243

*Primary Examiner* — Ricardo I Magallanes
(74) *Attorney, Agent, or Firm* — McClure, Qualey & Rodack, LLP

(57) ABSTRACT

A three-dimensional electronic component includes a first surface, a second surface, a third surface, and a fourth surface, and an antenna structure. The antenna structure includes a first radiating metal portion, a second radiating metal portion, an adjusting metal branch, a first ground connection portion, a second ground connection portion, a feed point, and a ground point. The first radiating metal portion on the first surface extends to the second surface. The second radiating metal portion on the first surface extends to the third surface. A gap is between the first radiating metal portion and the second radiating metal portion. The adjusting metal branch on the first surface is connected to the first radiating metal portion. The feed point on the first radiating metal portion is close to the gap. The ground point on the second radiating metal portion is close to the gap.

21 Claims, 9 Drawing Sheets

(56) References Cited

U.S. PATENT DOCUMENTS

| | | | | |
|---|---|---|---|---|
| 6,172,646 | B1 * | 1/2001 | Kawahata | H01Q 1/244 343/702 |
| 6,275,192 | B1 * | 8/2001 | Kim | H01Q 9/285 343/831 |
| 6,297,776 | B1 * | 10/2001 | Pankinaho | H01Q 1/48 343/846 |
| 6,542,124 | B1 * | 4/2003 | Yoon | H01Q 1/38 343/702 |
| 7,081,853 | B2 * | 7/2006 | Amano | H01Q 1/243 343/702 |
| 7,109,921 | B2 * | 9/2006 | Leelaratne | H01Q 9/045 343/700 MS |
| 7,432,865 | B2 * | 10/2008 | Tsai | H01Q 1/38 343/702 |
| 9,992,312 | B1 | 6/2018 | Deng et al. | |
| 10,056,696 | B2 | 8/2018 | Tseng et al. | |
| 11,081,782 | B2 * | 8/2021 | Chang | H01Q 1/243 |
| 2004/0085245 | A1 * | 5/2004 | Miyata | H01Q 5/371 343/702 |
| 2005/0259007 | A1 * | 11/2005 | Horie | H01Q 1/243 343/702 |
| 2006/0187121 | A1 * | 8/2006 | Chang | H01Q 9/0421 343/702 |
| 2007/0115177 | A1 * | 5/2007 | Kawahata | H01Q 1/243 343/702 |

* cited by examiner

THREE-DIMENSIONAL ELECTRONIC COMPONENT AND ELECTRONIC DEVICE

CROSS-REFERENCE TO RELATED APPLICATION

This application claims the priority benefit of Taiwan Application Serial No. 109134311, filed on Sep. 30, 2020. The entirety of the above-mentioned patent application is hereby incorporated by reference herein and made a part of specification.

BACKGROUND OF THE INVENTION

Field of the Invention

The disclosure relates to a three-dimensional electronic component and an electronic device including the three-dimensional electronic component.

Description of the Related Art

In design of an antenna inside a metal casing, a solution to improve antenna efficiency is generally to open an antenna window in the metal casing. However, the opening of the antenna window affects the appearance of the casing. Therefore, it is a trade off between the integrity of the metal casing and the performance of the antenna while considering the appearance of the metal casing. On the other hand, in a design in which no antenna window can be provided, an antenna is directly conducting on a metal ground. Such disposition maintains a distance between a surface of the antenna and the metal ground. However, limited by problems such as stack-up, the distance generally cannot exceed 5 mm, and an antenna design within the distance has poor antenna efficiency. As a result, a position in which an antenna is designed is usually limited by a physical size.

BRIEF SUMMARY OF THE INVENTION

According to the first aspect of the disclosure, a three-dimensional electronic component is provided. The three-dimensional electronic component includes at least four surfaces and an antenna structure. The four surfaces include a first surface, a second surface, a third surface, and a fourth surface. The first surface is adjacent to the second surface and the third surface, and the fourth surface is adjacent to the second surface and the third surface and is opposite to the first surface. The antenna structure is located on the four surfaces, and includes a first radiating metal portion, a second radiating metal portion, at least one adjusting metal branch, a first ground connection portion, a second ground connection portion, a feed point, and a ground point. The first radiating metal portion is located on the first surface and extends to the second surface. The second radiating metal portion is located on the first surface and extends to the third surface. There is a gap between the first radiating metal portion and the second radiating metal portion that are located on the first surface. The adjusting metal branch is located on the first surface and connected to the first radiating metal portion. The feed point is disposed on the first radiating metal portion and close to the gap. The ground point is disposed on the second radiating metal portion and close to the gap to correspond to the feed point. The first ground connection portion is connected to the first radiating metal portion, is located on the fourth surface, and is grounded. The second ground connection portion is connected to the second radiating metal portion, is located on the fourth surface, and is grounded.

According to the second aspect of the disclosure, an electronic device is provided. The electronic device includes a casing and a three-dimensional electronic component disposed in the casing. The three-dimensional electronic component includes at least four surfaces and an antenna structure. The four surfaces include a first surface, a second surface, a third surface, and a fourth surface. The first surface is adjacent to the second surface and the third surface, and the fourth surface is adjacent to the second surface and the third surface and is opposite to the first surface. The antenna structure is located on the four surfaces, and includes a first radiating metal portion, a second radiating metal portion, at least one adjusting metal branch, a first ground connection portion, a second ground connection portion, a feed point, and a ground point. The first radiating metal portion is located on the first surface and extends to the second surface. The second radiating metal portion is located on the first surface and extends to the third surface. There is a gap between the first radiating metal portion and the second radiating metal portion that are located on the first surface. The adjusting metal branch is located on the first surface and connected to the first radiating metal portion. The feed point is disposed on the first radiating metal portion and close to the gap. The ground point is disposed on the second radiating metal portion and close to the gap to correspond to the feed point. The first ground connection portion is connected to the first radiating metal portion, is located on the fourth surface, and is grounded. The second ground connection portion is connected to the second radiating metal portion, is located on the fourth surface, and is grounded.

Therefore, the antenna structure in the disclosure is directly disposed on an outer surface of a three-dimensional electronic component. The shape, the length, and the adjusting metal branch for matching the antenna are correspondingly adjusted according to the size and the specifications of the three-dimensional electronic component, to maintain antenna efficiency while maintaining overall appearance integrity, thereby overcoming a physical size limitation.

DETAILED DESCRIPTION OF THE EMBODIMENTS

Figure 1:
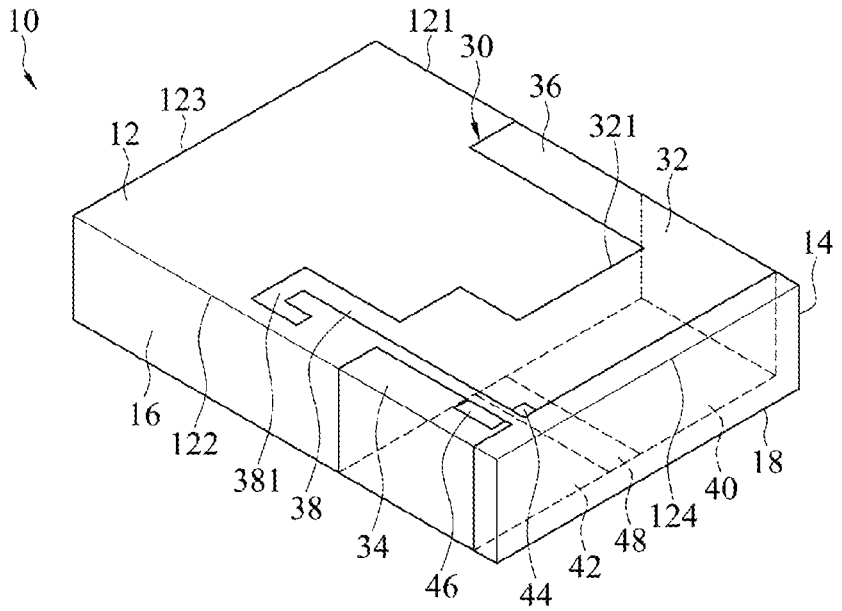
FIG. 1 is a schematic three-dimensional diagram of a three-dimensional electronic component according to an embodiment of the disclosure.
Figure 2:
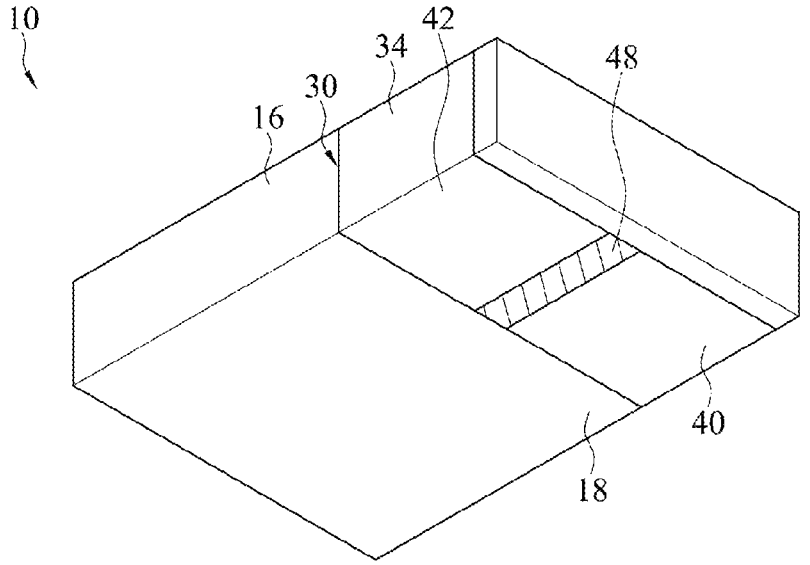
FIG. 2 is a schematic bottom view of a three-dimensional electronic component according to an embodiment of the disclosure.
Figure 3:
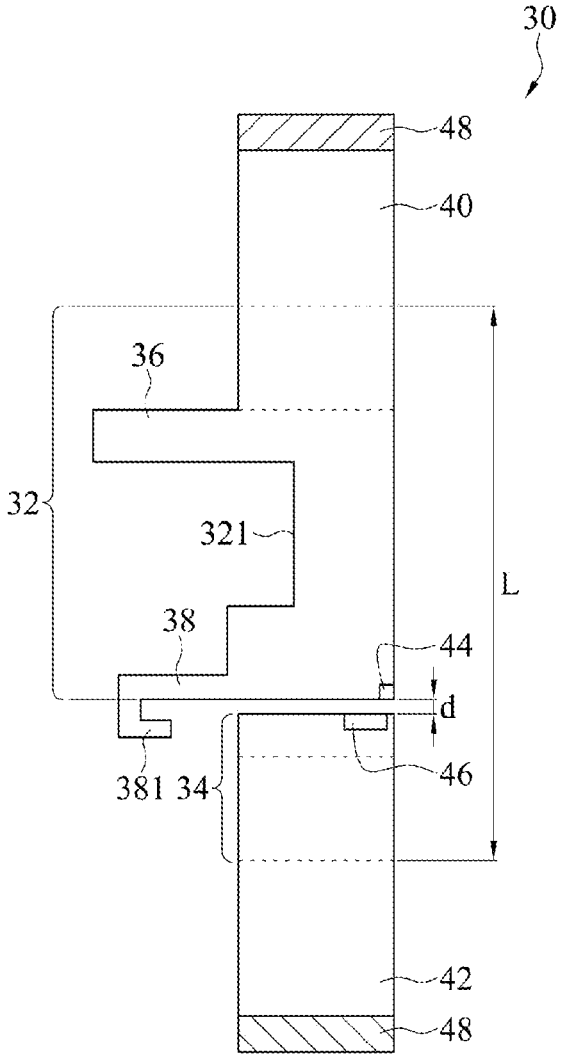
FIG. 3 is a schematic expanded view of a three-dimensional electronic component according to an embodiment of the disclosure.

Referring to all of FIG. 1, FIG. 2, and FIG. 3, a three-dimensional electronic component 10 includes at least four surfaces: a first surface 12, a second surface 14, a third surface 16, and a fourth surface 18, and an antenna structure 30. Two sides of the first surface 12 are respectively adjacent to the second surface 14 and the third surface 16, two sides of the fourth surface 18 are respectively adjacent to the second surface 14 and the third surface 16, and the fourth surface 18 is opposite to the first surface 12, so that the first surface 12, the second surface 14, the fourth surface 18, and the third surface 16 are connected in sequence. The first surface 12 includes a first side edge 121 and a second side edge 122 opposite to each other, and a third side edge 123 and a fourth side edge 124 opposite to each other. The third side edge 123 is connected to the first side edge 121 and the second side edge 122. The fourth side edge 124 is connected to the first side edge 121 and the second side edge 122.

The antenna structure 30 includes a first radiating metal portion 32, a second radiating metal portion 34, two adjusting metal branches (including a first adjusting metal branch 36 and a second adjusting metal branch 38), a first ground connection portion 40, a second ground connection portion 42, a feed point 44, and a ground point 46. The first radiating metal portion 32 is located on the first surface 12, which bends and extends from the first side edge 121 to the second surface 14. A side edge of the first radiating metal portion 32 close to the third side edge 123 further includes a first recessed portion 321. The position, the shape, and the size of the first recessed portion 321 match a shape or a structure on the first surface 12 of the three-dimensional electronic component 10 to avoid a metal member or a decoration member of the three-dimensional electronic component 10. The second radiating metal portion 34 is located on the first surface 12, which bends and extends from the second side edge 122 to the third surface 16. There is a gap d between the first radiating metal portion 32 and the second radiating metal portion 34 that are located on the first surface 12. The first adjusting metal branch 36 and the second adjusting metal branch 38 are located on the first surface 12 and individually connected to the first radiating metal portion 32. In an embodiment, the first adjusting metal branch 36 is located on the first surface 12 and extends along the first side edge 121 from the first radiating metal portion 32 toward the third side edge 123. The second adjusting metal branch 38 is located on the first surface 12 and extends along the second side edge 122 from the first radiating metal portion 32 toward the third side edge 123. An end of the second adjusting metal branch 38 bends and extends toward the second side edge 122 and includes a bending portion 381, but the disclosure is not limited thereto. In another embodiment, the first adjusting metal branch 36 and the second adjusting metal branch 38 are adjusted according to an actual requirement. The feed point 44 is disposed on an edge of the first radiating metal portion 32 and is close to the gap d. The ground point 46 is disposed on an edge of the second radiating metal portion 34 and is close to the gap d to correspond to the feed point 44. The feed point 44 and the ground point 46 are electrically connected to a signal source (not shown in the figure). A positive end of the signal source is connected to the feed point 44, and a negative end is connected to the ground point 46, so that a radio frequency signal generated by the signal source is fed from the feed point 44. The first ground connection portion 40 is connected to the first radiating metal portion 32 and is located on the fourth surface 18 for grounding. The second ground connection portion 42 is connected to the second radiating metal portion 34 and is located on the fourth surface 18 for grounding. In this embodiment, one side of the first ground connection portion 40 is connected to the first radiating metal portion 32, an other side of the first ground connection portion 40 extends toward the second ground connection portion 42, one side of the second ground connection portion 42 is connected to the second radiating metal portion 34, and an other side of the second ground connection portion 42 extends toward the first ground connection portion 40, so that the first ground connection portion 40 and the second ground connection portion 42 partially overlap to form a ground overlap region 48, so as to indeed achieve a grounding effect.

When the radio frequency signal is fed into the antenna structure 30 from the feed point 44, the antenna structure 30 is excited by the first radiating metal portion 32, the second radiating metal portion 34, the first adjusting metal branch 36, and a second adjusting metal branch 38 (including the bending portion 381) to generate a fundamental frequency mode close to a low-frequency operating frequency band, and generate a frequency-doubling resonance mode in a high-frequency operating frequency band.

In an embodiment, the gap d between the first radiating metal portion 32 and the second radiating metal portion 34 is less than 3 mm, and preferably, is 1 to 2 mm.

In an embodiment, a total length of the first radiating metal portion 32, the gap d, and the second radiating metal portion 34 is a quarter of a wavelength of an antenna operating frequency.

Figure 4:
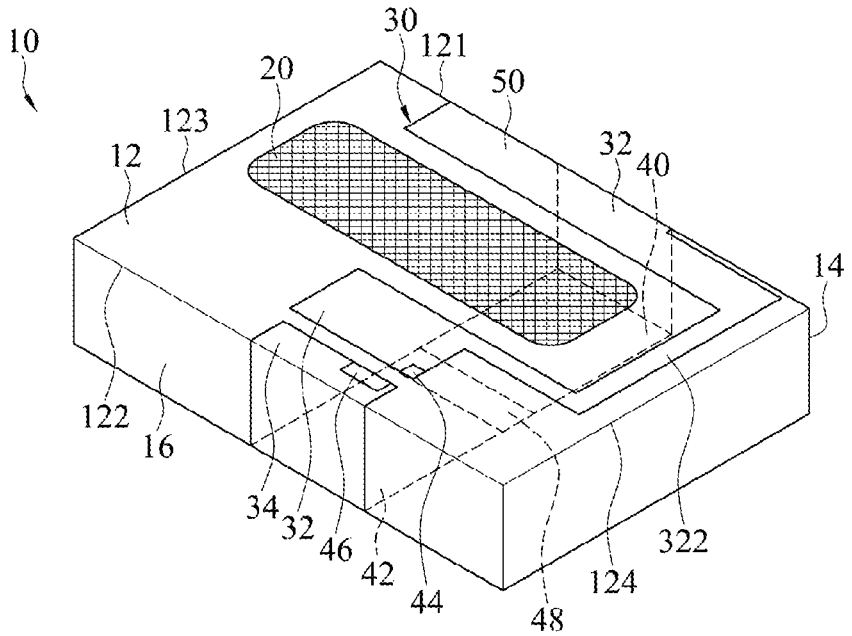
FIG. 4 is a schematic three-dimensional diagram of a three-dimensional electronic component according to another embodiment of the disclosure.
Figure 5:
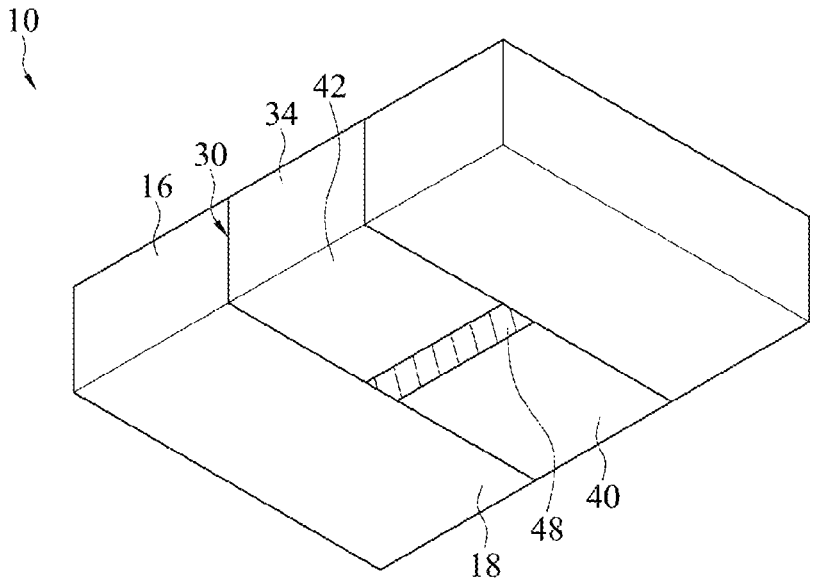
FIG. 5 is a schematic bottom view of a three-dimensional electronic component according to another embodiment of the disclosure.
Figure 6:
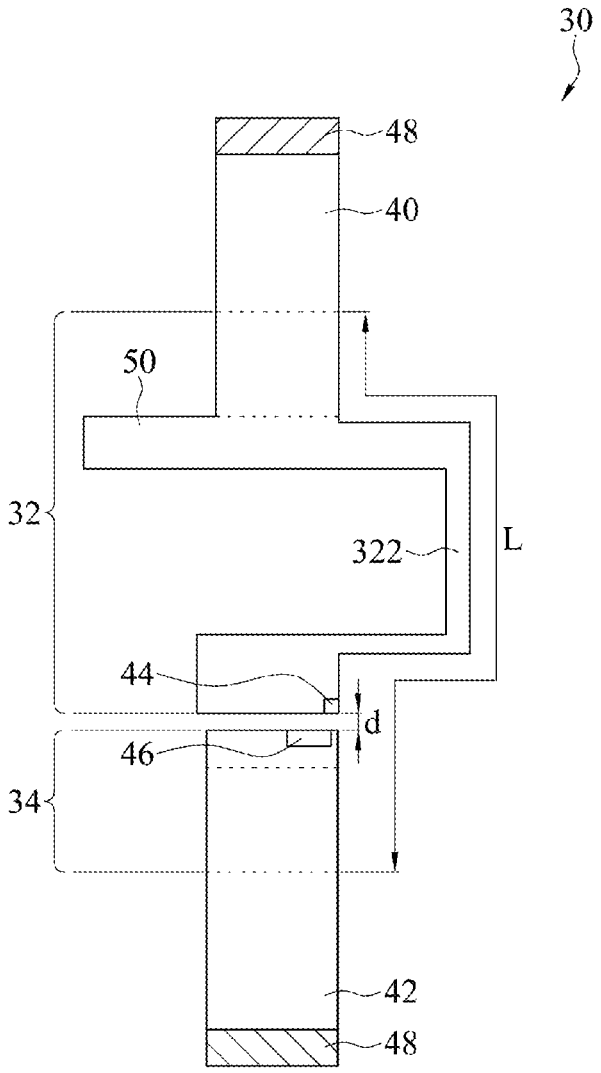
FIG. 6 is a schematic expanded view of a three-dimensional electronic component according to another embodiment of the disclosure.

Referring to all of FIG. 4, FIG. 5, and FIG. 6, a three-dimensional electronic component 10 includes a first surface 12, a second surface 14, a third surface 16, and a fourth surface 18, and an antenna structure 30. The antenna structure 30 includes a first radiating metal portion 32, a second radiating metal portion 34, an adjusting metal branch 50, a first ground connection portion 40, a second ground connection portion 42, a feed point 44, and a ground point 46. The first radiating metal portion 32 is located on the first surface 12, which bends and extends from a first side edge 121 to the second surface 14. To avoid a metal member or a decoration member on the three-dimensional electronic component 10, the first radiating metal portion 32 further includes a bent metal branch 322 to bypass the metal member 20, so that the bent metal branch 322 is located at a periphery of the metal member 20. The second radiating metal portion 34 is located on the first surface 12, which bends and extends from a second side edge 122 to the third surface 16. There is a gap d between the first radiating metal portion 32 and the second radiating metal portion 34 that are located on the first surface 12. The first adjusting metal branch 50 is located on the first surface 12 and extends along the first side edge 121 from the first radiating metal portion 32 toward the third side edge 123. The feed point 44 is disposed on a side edge of the first radiating metal portion 32 and is close to the gap d. The ground point 46 is disposed on an edge of the second radiating metal portion 34 and is close to the gap d. The feed point 44 and the ground point 46 are electrically connected to a signal source. The first ground connection portion 40 is connected to the first radiating metal portion 32 and is located on the fourth surface 18 for grounding. The second ground connection portion 42 is connected to the second radiating metal portion 34 and is located on the fourth surface 18 for grounding. The same as the foregoing embodiment, one side of the first ground connection portion 40 is connected to the first radiating metal portion 32, an other side thereof extends toward the second ground connection portion 42, one side of the second ground connection portion 42 is connected to the second radiating metal portion 34, and an other side thereof extends toward the first ground connection portion 40, so that the first ground connection portion 40 and the second ground connection portion 42 partially overlap to form a ground overlap region 48.

When a radio frequency signal is fed into the antenna structure 30 from the feed point 44, the antenna structure 30 is excited by the first radiating metal portion 32 (including the bent metal branch 322), the second radiating metal portion 34, and the adjusting metal branch 50 to generate a fundamental frequency mode close to a low-frequency operating frequency band, and generate a frequency-doubling resonance mode in a high-frequency operating frequency band.

Figure 7:
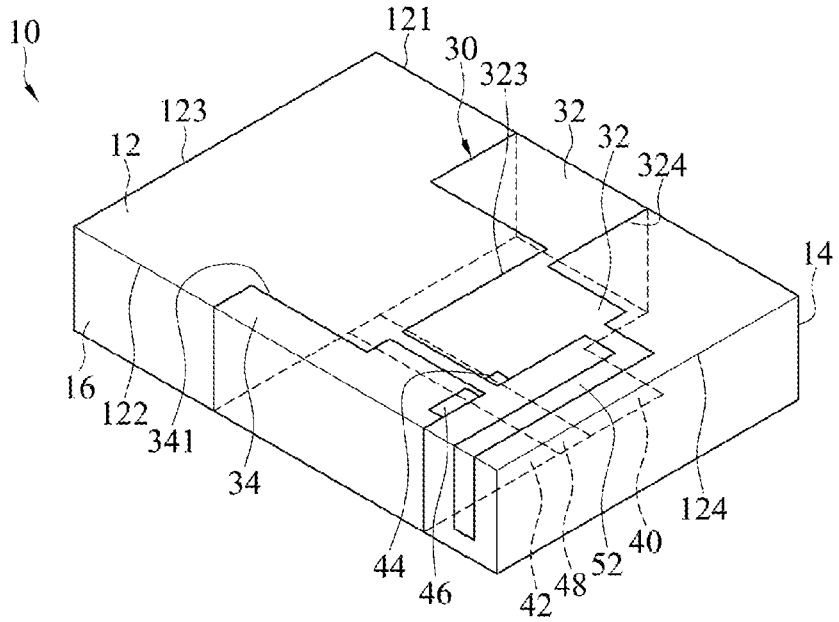
FIG. 7 is a schematic three-dimensional diagram of a three-dimensional electronic component according to still another embodiment of the disclosure.
Figure 8:
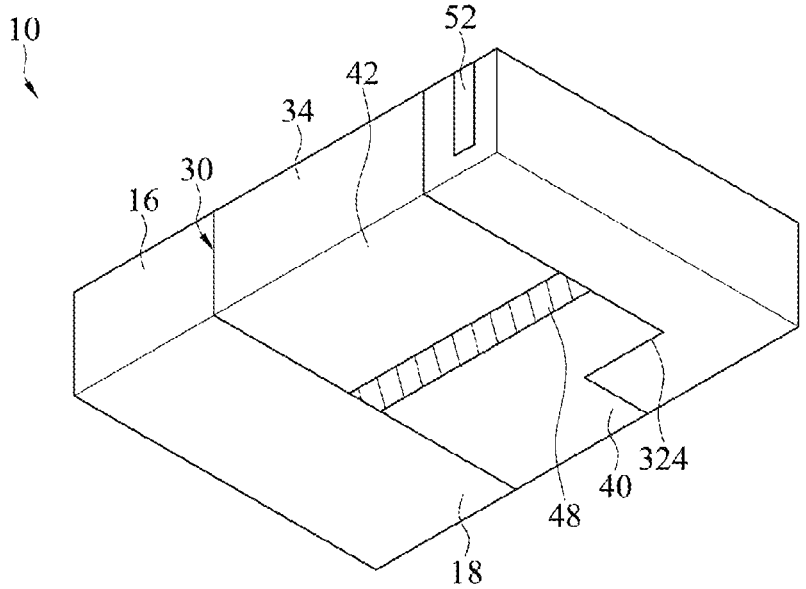
FIG. 8 is a schematic bottom view of a three-dimensional electronic component according to still another embodiment of the disclosure.
Figure 9:
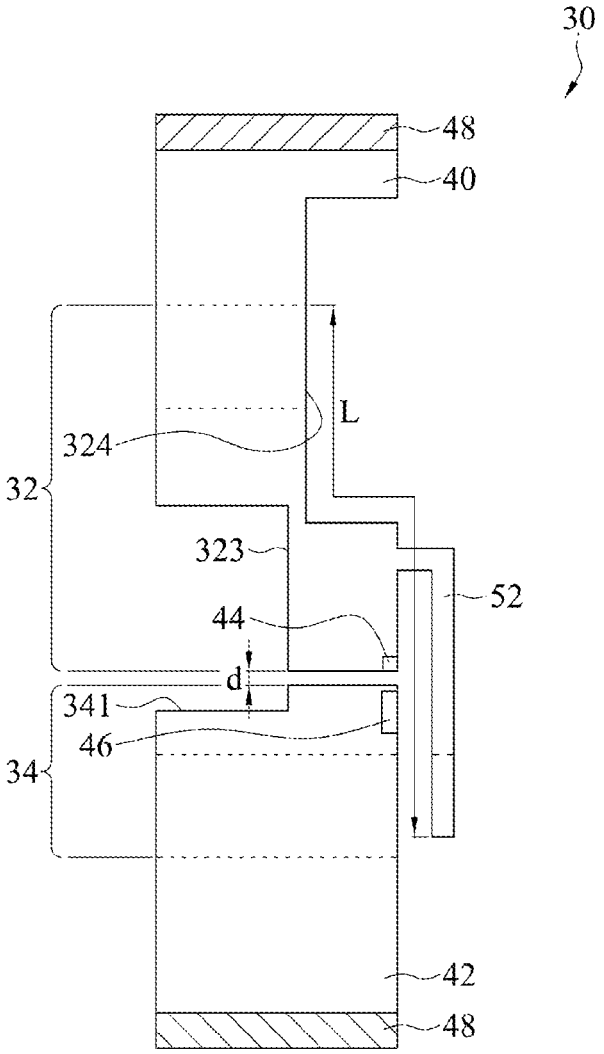
FIG. 9 is a schematic expanded view of a three-dimensional electronic component according to still another embodiment of the disclosure.

Referring to all of FIG. 7, FIG. 8, and FIG. 9, a three-dimensional electronic component 10 includes a first surface 12, a second surface 14, a third surface 16, and a fourth surface 18, and an antenna structure 30. The antenna structure 30 is includes a first radiating metal portion 32, a second radiating metal portion 34, an adjusting metal branch 52, a first ground connection portion 40, a second ground connection portion 42, a feed point 44, and a ground point 46. The first radiating metal portion 32 is located on the first surface 12 and bends and extends from a first side edge 121 to the second surface 14. The second radiating metal portion 34 is located on the first surface 12, and bends and extends from a second side edge 122 to the third surface 16. There is a gap d between the first radiating metal portion 32 and the second radiating metal portion 34 that are located on the first surface 12. The adjusting metal branch 52 is located on the first surface 12 and connected to the first radiating metal portion 32, so as to extend by a distance from the first radiating metal portion 32 toward a direction of the fourth side edge 124, then bend to extend along the fourth side edge 124 toward the second side edge 122, and extend to the third surface 16. The feed point 44 is disposed on an edge of the first radiating metal portion 32 and is close to the gap d. The ground point 46 is disposed on an edge of the second radiating metal portion 34 and is close to the gap d. The feed point 44 and the ground point 46 are electrically connected to a signal source. The first ground connection portion 40 is connected to the first radiating metal portion 32 and is located on the fourth surface 18. The second ground connection portion 42 is connected to the second radiating metal portion 34 and is located on the fourth surface 18. The first ground connection portion 40 and the second ground connection portion 42 partially overlap to form a ground overlap region 48. A side edge of the first radiating metal portion 32 close to the third side edge 123 includes a first recessed portion 323, and a side edge thereof close to the fourth side edge 124 includes a third recessed portion 324. The third recessed portion 324 extends to the first ground connection portion 40 on the fourth surface 18. The second radiating metal portion 34 further includes a second recessed portion 341 to correspond to the first recessed portion 323 to match a structure design on the first surface 12. Positions, shapes, and sizes of the first recessed portion 323, the second recessed portion 341, and the third recessed portion 324 are designed to match a metal member or a decoration member on a surface of the three-dimensional electronic component 10, to dispose the metal member or the decoration member at a vacant space on the surface of the three-dimensional electronic component 10.

When a radio frequency signal is fed into the antenna structure 30 from the feed point 44, the antenna structure 30 is excited by the first radiating metal portion 32, the second radiating metal portion 34, and the adjusting metal branch 52 to generate a fundamental frequency mode close to a low-frequency operating frequency band, and generate a frequency-doubling resonance mode in a high-frequency operating frequency band.

Figure 10:
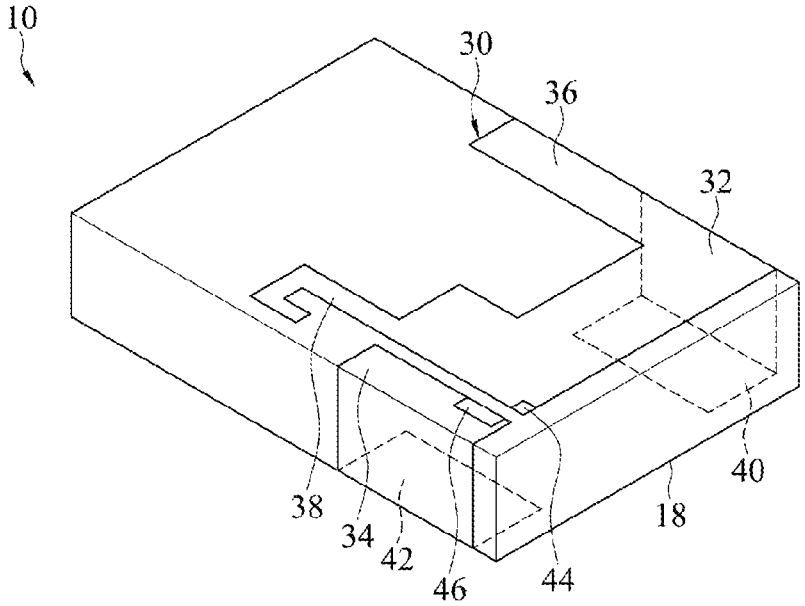
FIG. 10 is a schematic three-dimensional diagram of a three-dimensional electronic component including a metal surface according to an embodiment of the disclosure.
Figure 11:
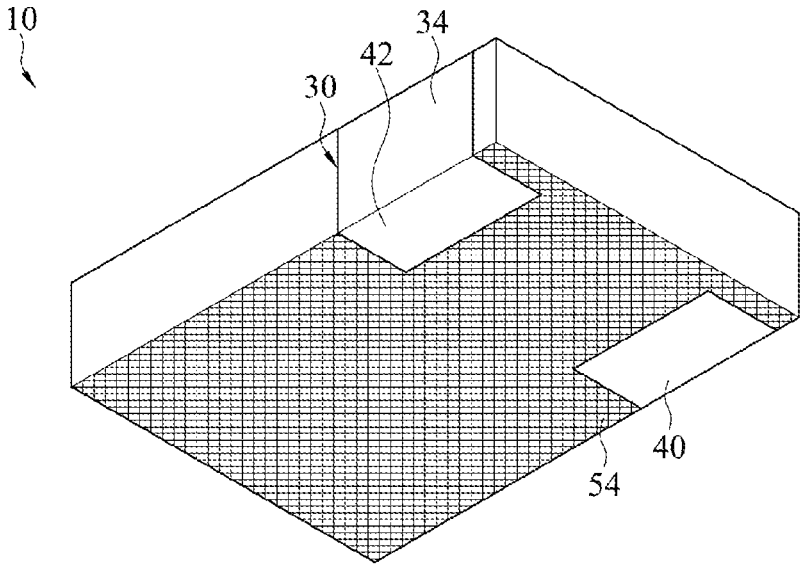
FIG. 11 is a schematic bottom view of the three-dimensional electronic component in FIG. 10.

In an embodiment, referring to both FIG. 10 and FIG. 11, when the fourth surface 18 of the three-dimensional electronic component 10 is a metal surface 54, provided that the metal surface 54 is grounded (that is, provided that the first ground connection portion 40 and the second ground connection portion 42 are connected to the metal surface 54), the first ground connection portion 40 and the second ground connection portion 42 may not overlap. The remaining structural features are the same as those in the embodiment shown in FIG. 1. Therefore, refer to the foregoing descriptions. Details are not described herein again.

Figure 12:
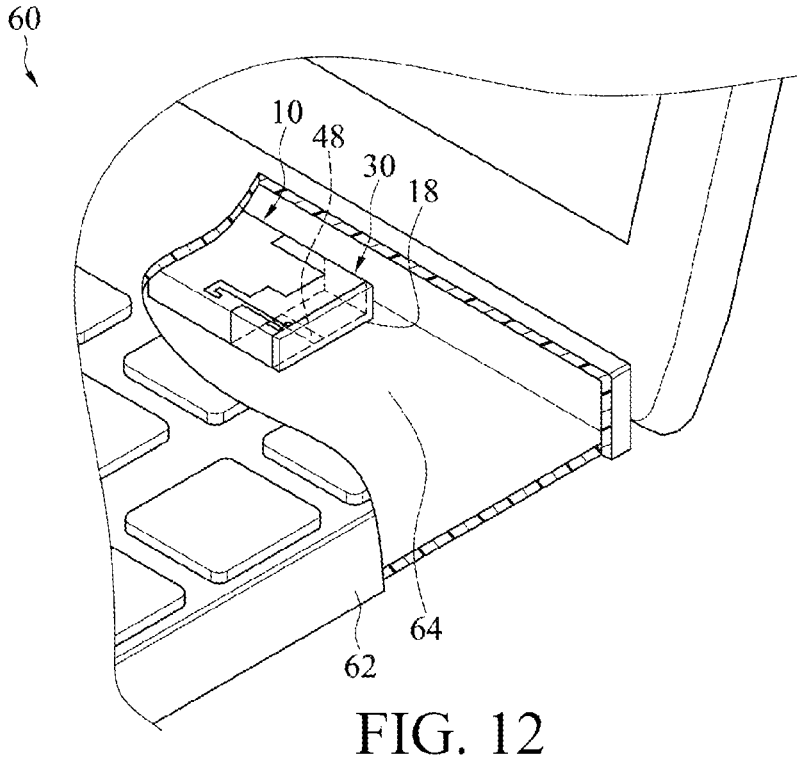
FIG. 12 is a schematic three-dimensional diagram of an electronic device according to an embodiment of the disclosure.

In an embodiment, referring to FIG. 12, an electronic device 60 includes a casing 62 and a three-dimensional electronic component 10 located in the casing 62. The three-dimensional electronic component 10 in FIG. 1 is used as an example herein. In another embodiment, the three-dimensional electronic component 10 in FIG. 1 is alternatively replaced with the three-dimensional electronic component 10 in FIG. 3 or FIG. 5. When a mounting surface of the casing 62 in contact with the fourth surface 18 of the three-dimensional electronic component 10 is not a metal surface 64, the antenna structure 30 includes the ground overlap region 48 to ensure a grounding function. The remaining structural features are the same as those in the embodiment shown in FIG. 1. Therefore, refer to the foregoing descriptions. Details are not described herein again. In an embodiment, the electronic device 60 is a notebook computer, a mobile phone, a personal digital assistant (PDA), a tablet computer, or the like, but the disclosure is not limited thereto.

Figure 13:
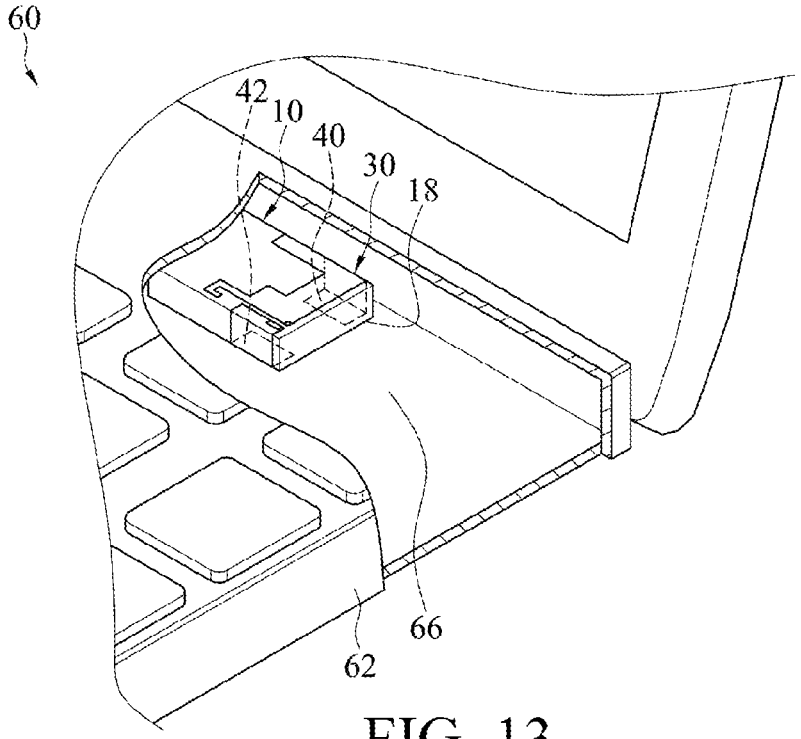
FIG. 13 is a schematic three-dimensional diagram of an electronic device according to another embodiment of the disclosure.

In an embodiment, referring to FIG. 13, an electronic device 60 includes a casing 62 and a three-dimensional electronic component 10 located in the casing 62. When a mounting surface of the casing 62 in contact with a fourth surface 18 of the three-dimensional electronic component 10 is a metal surface 66, a first ground connection portion 40 and a second ground connection portion 42 are in contact with the metal surface 66 and are grounded. Provided that the first ground connection portion 40 and the second ground connection portion 42 are in contact with the metal surface 66 of the casing 62, the first ground connection portion 40 and the second ground connection portion 42 may not overlap. The remaining structural features are the same as those in the embodiment shown in FIG. 10. Therefore, refer to the foregoing descriptions. Details are not described herein again.

Similarly, in the antenna structure 30 shown in FIG. 4 and the antenna structure 30 shown in FIG. 7, when the fourth surface 18 of the three-dimensional electronic component 10 is a metal surface, or the mounting surface of the casing 62 of the electronic device 60 shown in FIG. 13 is the metal surface 66, the first ground connection portion 40 and the second ground connection portion 42 may or may not overlap.

In an embodiment, the three-dimensional electronic component 10 is a casing of a speaker, a support component or a hinge cap provided that the three-dimensional electronic component includes enough space for disposing all components in the antenna structure 30.

In an embodiment, referring to FIG. 1 to FIG. 9, the first radiating metal portion 32, the second radiating metal portion 34, the first adjusting metal branch 36, the second adjusting metal branch 38, the adjusting metal branch 50, the adjusting metal branch 52, the first ground connection portion 40, the second ground connection portion 42, and the like are made of conductive materials such as copper, silver, aluminum, iron, or alloys thereof, but are not limited thereto.

Referring to all of FIG. 1 to FIG. 11, the three-dimensional electronic components 10 of different sizes affect a total length L of the antenna. Therefore, the total length L of the antenna is maintained at a length of a quarter of a wavelength of an antenna operating frequency as long as possible, so that the antenna structure 30 is excited to generate a fundamental frequency mode close to a low-frequency operating frequency band (2.45 GHz), and generate a frequency-doubling resonance mode in a high-frequency operating frequency band (5 to 7 GHz), to meet requirements of high-frequency and low-frequency operating frequency bandwidths of a WLAN. An adjusting metal branch is further added according to the proximity of the operating frequency band. Positions and a quantity of the adjusting metal branches are determined according to actual requirements, and vary with shapes and structures provided by the three-dimensional electronic components 10. A length and a direction of the adjusting metal branch are adjusted according to actual requirements and limitations, and are not limited to the embodiments listed in the disclosure. In an embodiment, the adjusting metal branch is disposed close to the feed point 44 and the ground point 46 as much as possible, so as to adjust resonance frequency more effectively, to compensate for a resonance length.

Figure 14:
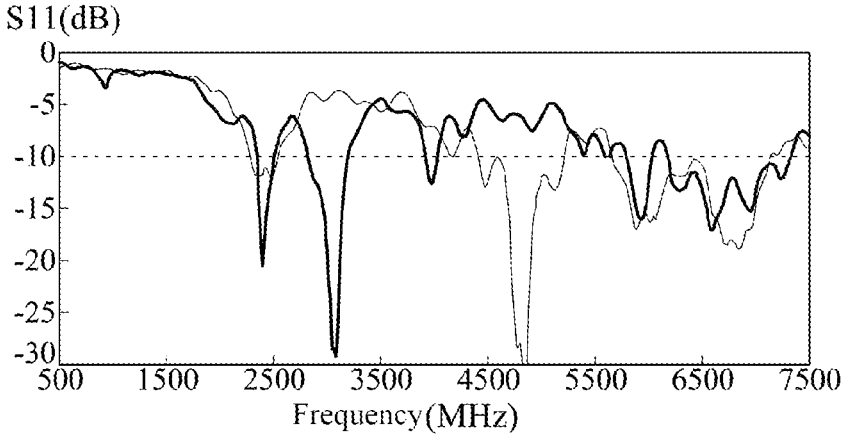
FIG. 14 is a schematic diagram of S-parameter simulation of the three-dimensional electronic components according to FIG. 1 and FIG. 4 of the disclosure.

Referring to all of FIG. 1, FIG. 4, and FIG. 14, S-parameter simulation is performed during transmission of a radio frequency signal by using the antenna structure 30 shown in FIG. 1 and the antenna structure 30 shown in FIG. 4. In a low-frequency operating frequency band (2.4 to 2.5 GHz) and a high-frequency operating frequency band (5 to 7 GHz), S-parameter simulation results are shown in FIG. 14. The S-parameter simulation result of the antenna structure 30 in FIG. 1 is shown as a thick curve, and the S-parameter simulation result of the antenna structure 30 in FIG. 4 is shown as a thin curve. Return losses (S11) of the antenna structure 30 shown in FIG. 1 and the antenna structure 30 shown in FIG. 4 in antenna resonance frequency bands of the low-frequency operating frequency band (2.4 to 2.5 GHz) and the high-frequency operating frequency band (5 to 7 GHz) are almost always greater than 10 dB (S11<−10 dB). Therefore, from the foregoing proof, it can be learned that the antenna structure 30 of the three-dimensional electronic component 10 in the disclosure has a good return loss.

In conclusion, the antenna structure in the disclosure is directly disposed on an outer surface of a three-dimensional electronic component. The shape, the length, and the adjusting metal branch for matching the antenna are correspondingly adjusted according to the size and the specifications of the three-dimensional electronic component, to maintain antenna efficiency while maintaining overall appearance integrity, thereby overcoming a physical size limitation.

The embodiments described above are only used for explaining the technical ideas and characteristics of the disclosure to enable a person skilled in the art to understand and implement the content of the disclosure, and are not intended to limit the patent scope of the disclosure. That is, any equivalent change or modification made according to the spirit disclosed in the disclosure shall still fall within the patent scope of the disclosure.

What is claimed is:

1. A three-dimensional electronic component, comprising:

at least four surfaces, comprising a first surface, a second surface, a third surface, and a fourth surface, wherein the first surface is adjacent to the second surface and the third surface, and the fourth surface is adjacent to the second surface and the third surface and is opposite to the first surface; and an antenna structure, located on the four surfaces and comprising:

a first radiating metal portion, located on the first surface and extending to the second surface;

a second radiating metal portion, located on the first surface and extending to the third surface, wherein there is a gap between the first radiating metal portion and the second radiating metal portion that are located on the first surface;

at least one adjusting metal branch, located on the first surface and connected to the first radiating metal portion;

a feed point, disposed on the first radiating metal portion and close to the gap;

a ground point, disposed on the second radiating metal portion and close to the gap;

a first ground connection portion, connected to the first radiating metal portion, located on the fourth surface, and grounded; and a second ground connection portion, connected to the second radiating metal portion, located on the fourth surface, and grounded.

2. The three-dimensional electronic component according to claim 1, wherein the antenna structure further comprises a signal source electrically connected to the feed point and the ground point.

3. The three-dimensional electronic component according to claim 1, wherein the first radiating metal portion further comprises at least one first recessed portion.

4. The three-dimensional electronic component according to claim 3, wherein the second radiating metal portion further comprises a second recessed portion.

5. The three-dimensional electronic component according to claim 1, wherein the first radiating metal portion further comprises a bent metal branch.

6. The three-dimensional electronic component according to claim 1, wherein the first ground connection portion and the second ground connection portion further partially overlap and are grounded.

7. The three-dimensional electronic component according to claim 1, wherein when the fourth surface is a metal surface, the first ground connection portion and the second ground connection portion are connected to the metal surface and are grounded.

8. The three-dimensional electronic component according to claim 1, wherein a total length of the first radiating metal portion, the gap, and the second radiating metal portion is a quarter of a wavelength of an antenna operating frequency.

9. The three-dimensional electronic component according to claim 1, wherein the adjusting metal branch further comprises at least one bending portion.

10. The three-dimensional electronic component according to claim 1, wherein the adjusting metal branch further extends to the third surface.

11. An electronic device, comprising:

a casing; and a three-dimensional electronic component, disposed in the casing and comprising:

at least four surfaces, comprising a first surface, a second surface, a third surface, and a fourth surface, wherein the first surface is adjacent to the second surface and the third surface, and the fourth surface is adjacent to the second surface and the third surface and is opposite to the first surface; and an antenna structure, located on the four surfaces and comprising:

a first radiating metal portion, located on the first surface and extending to the second surface;

a second radiating metal portion, located on the first surface and extending to the third surface, wherein there is a gap between the first radiating metal portion and the second radiating metal portion that are located on the first surface;

at least one adjusting metal branch, located on the first surface and connected to the first radiating metal portion;

a feed point, disposed on the first radiating metal portion and close to the gap;

a ground point, disposed on the second radiating metal portion and close to the gap;

a first ground connection portion, connected to the first radiating metal portion, located on the fourth surface, and grounded; and a second ground connection portion, connected to the second radiating metal portion, located on the fourth surface, and grounded.

12. The electronic device according to claim 11, wherein the antenna structure further comprises a signal source electrically connected to the feed point and the ground point.

13. The electronic device according to claim 11, wherein the first radiating metal portion further comprises at least one first recessed portion.

14. The electronic device according to claim 13, wherein the second radiating metal portion further comprises a second recessed portion.

15. The electronic device according to claim 11, wherein the first radiating metal portion further comprises a bent metal branch.

16. The electronic device according to claim 11, wherein the first ground connection portion and the second ground connection portion further partially overlap and are grounded.

17. The electronic device according to claim 11, wherein when the fourth surface is a metal surface, the first ground connection portion and the second ground connection portion are connected to the metal surface and are grounded.

18. The electronic device according to claim 11, wherein when a mounting surface of the casing in contact with the fourth surface is a metal surface, the first ground connection portion and the second ground connection portion are connected to the metal surface, and are grounded.

19. The electronic device according to claim 11, wherein a total length of the first radiating metal portion, the gap, and the second radiating metal portion is a quarter of a wavelength of an antenna operating frequency.

20. The electronic device according to claim 11, wherein the adjusting metal branch further comprises at least one bending portion.

21. The electronic device according to claim 11, wherein the adjusting metal branch further extends to the third surface.

* * * * *